US012584472B2

(12) United States Patent
Kobayashi et al.

(10) Patent No.: US 12,584,472 B2
(45) Date of Patent: Mar. 24, 2026

(54) COMPRESSOR

(71) Applicant: Hitachi Astemo, Ltd., Hitachinaka (JP)

(72) Inventors: Kan Kobayashi, Hitachinaka (JP); Takao Nakadate, Hitachinaka (JP)

(73) Assignee: HITACHI ASTEMO, LTD., Ibaraki (JP)

( * ) Notice: Subject to any disclaimer, the term of this patent is extended or adjusted under 35 U.S.C. 154(b) by 93 days.

(21) Appl. No.: 18/292,600

(22) PCT Filed: Jun. 1, 2022

(86) PCT No.: PCT/JP2022/022314
§ 371 (c)(1),
(2) Date: Nov. 18, 2024

(87) PCT Pub. No.: WO2023/021809
PCT Pub. Date: Feb. 23, 2023

(65) Prior Publication Data

US 2025/0314243 A1 Oct. 9, 2025

(30) Foreign Application Priority Data

Aug. 19, 2021 (JP) ..... 2021-133756

(51) Int. Cl.
*F04B 39/10* (2006.01)
*F04B 39/00* (2006.01)

(52) U.S. Cl.
CPC ..... *F04B 39/10* (2013.01); *F04B 39/0016* (2013.01)

(58) Field of Classification Search
CPC .... F04B 39/0016; F04B 39/10; F04B 39/102; F04B 39/1033; F04B 39/1073; F04B 39/108; F04B 35/045
See application file for complete search history.

(56) References Cited

U.S. PATENT DOCUMENTS

2004/0047750 A1* 3/2004 Kim ..... F04B 35/045 417/551

FOREIGN PATENT DOCUMENTS

JP S55-14172 1/1980
JP H05-21185 3/1993
(Continued)

OTHER PUBLICATIONS

International Search Report issued Aug. 2, 2022 in International Application No. PCT/JP2022/022314, with English translation.
(Continued)

*Primary Examiner* — Loren C Edwards
(74) *Attorney, Agent, or Firm* — Wenderoth, Lind & Ponack, L.L.P.

(57) ABSTRACT

A piston (18) of a compressor (1) partitions the inside of a cylinder (17) into a compression chamber (21) and a suction chamber (22). A communication passage (19A) is formed in the piston (18). The communication passage (19A) establishes communication between the compression chamber (21) and the suction chamber (22). The suction valve (23) opens and closes an opening (19A1) of the communication passage (19A). The suction valve (23) has a plate-like shape. The suction valve (23) includes a fixation portion (23A) fixed to the piston (18), a closing portion (23B) configured to cover the opening (19A), and a spring portion (23C) connecting the fixation portion (23A) and the closing portion (23B). A spring portion facing portion (19B) in the piston (18), which faces the spring portion (23C) of the suction valve (23), is recessed more deeply than a closing portion facing portion (19C), which faces the closing portion (23B) of the suction valve (23).

3 Claims, 5 Drawing Sheets

(56) References Cited

FOREIGN PATENT DOCUMENTS

| | | | |
|---|---|---|---|
| JP | H07-208368 | | 8/1995 |
| JP | 2002-54571 | | 2/2002 |
| JP | 2017-106397 | | 6/2017 |
| KR | 10-2004-0025462 | | 3/2004 |
| KR | 20050060930 A | * | 6/2005 |

OTHER PUBLICATIONS

Written Opinion of the International Searching Authority issued Aug. 2, 2022 in International Application No. PCT/JP2022/022314, with English translation.

* cited by examiner

COMPRESSOR

TECHNICAL FIELD

The present disclosure relates to, for example, a compressor that generates compressed air.

BACKGROUND ART

For example, PTLs 1 and 2 each discuss a compressor that sucks air from a crank chamber side into a compression chamber via a communication passage formed in a piston. In this case, a plate-shaped valve (a suction valve) for opening/closing the opening of the communication passage is provided on the piston.

CITATION LIST

Patent Literature

PTL 1: Japanese Patent Application Laid-Open No. H07-208368

PTL 2: Japanese Patent Application Laid-Open No. 2017-106397

SUMMARY OF INVENTION

For example, securing an air volume and a pressure even when reducing the piston diameter (a cylinder diameter) of the compressor raises the necessity of enlarging the opening (a port diameter) of the communication passage and increasing the lift amount of the plate-shaped valve (a suction valve). On the other hand, the enlargement of the opening of the communication passage is accompanied by an increase in the area of a closing portion for closing the opening in the entire valve. This may make it difficult to secure a spring portion for increasing the lift amount, thereby making it difficult to secure the lift amount.

An object of one aspect of the present invention is to provide a compressor capable of achieving both "enlargement of an opening of a communication passage of a piston" and an "increase in a lift amount of a suction valve".

According to one aspect of the present invention, a compressor includes a piston partitioning an inside of a cylinder into a first chamber and a second chamber and configured to reciprocate, a communication passage formed in the piston and establishing communication between the first chamber and the second chamber, an opening provided on one end of the communication passage and a one-side surface of the piston on the first chamber side, and a suction valve configured to open and close the opening. The suction valve has a plate-like shape. The suction valve includes a fixation portion fixed to a center of the one-side surface, a closing portion on one radial side with respect to the fixation portion, and a spring portion on an opposite radial side with respect to the fixation portion. A spring portion facing portion on the one-side surface, which faces the spring portion, is recessed more deeply than a closing portion facing portion, which faces the closing portion.

According to the one aspect of the present invention, the compressor can achieve both "enlargement of an opening of a communication passage of a piston" and an "increase in a lift amount of a suction valve".

BRIEF DESCRIPTION OF DRAWINGS

FIG. 2 is an exploded perspective view illustrating a piston, a suction valve, and the like.

DESCRIPTION OF EMBODIMENTS

In the following description, a compressor according to an embodiment will be described citing an example in which this compressor is configured as a linear motor-type compressor with reference to the accompanying drawings. In the present embodiment, the linear motor-type compressor will be described citing an example in which it is mounted on a vehicle body as a part of an air suspension system of a four-wheeled automobile.

Figure 1:
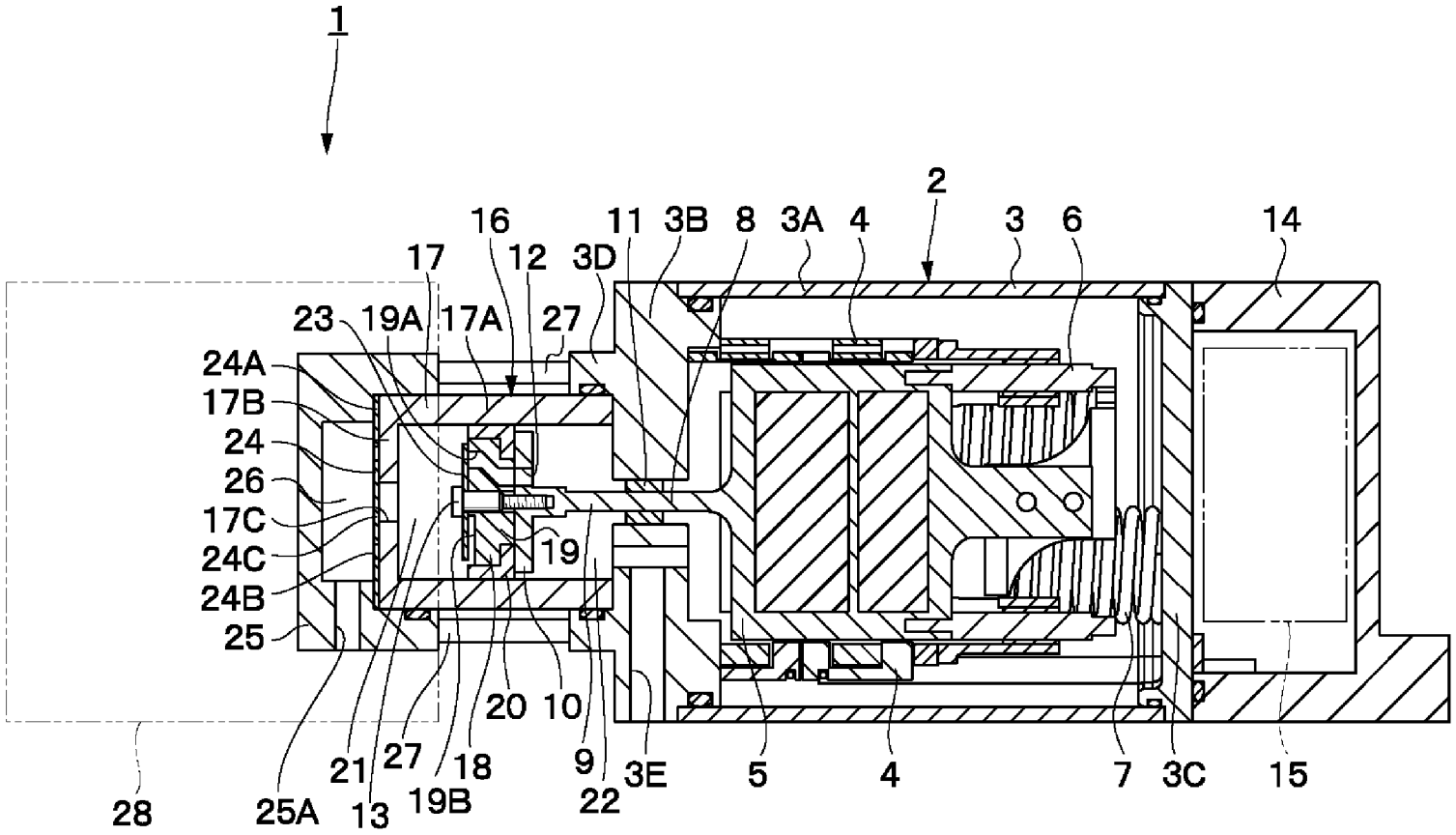
FIG. 1 is a vertical cross-sectional view illustrating a linear motor-type compressor according to an embodiment.

Referring to FIG. 1, a linear motor-type compressor 1 is configured as an air compressor. The compressor 1 can be used as, for example, a compressor that sucks atmospheric air and compresses it (a normal compressor) and/or a compressor that sucks compressed air (compression air) from a tank or the like and further compresses it (a booster compressor). The compressor 1 includes a linear motor 2 and a compression portion 16. The linear motor 2 serves as a driving source. The compression portion 16 includes a cylinder 17 and a piston 18. The linear motor 2 applies a current to each of coils (not illustrated) of armatures 4 to thus cause a movable element 5 to reciprocate in a length direction (the horizontal direction in FIG. 1), thereby causing the piston 18 of the compression portion 16 to reciprocate in the same direction.

The linear motor 2 is mounted on, for example, a vehicle body (not illustrated) of a vehicle (an automobile) together with the compression portion 16. The linear motor 2 includes a casing 3 forming an outer shell, and the armatures 4, the movable element 5, a support member 6, and a spring 7 arranged in the casing 3. The casing 3 of the linear motor 2 is formed as a hollow container. More specifically, the casing 3 includes a tubular case main body 3A, a cylinder-side partition wall portion 3B, and an inverter-side partition wall portion 3C. The case main body 3A is opened on each of both axial sides thereof. The cylinder-side partition wall portion 3B closes the cylinder 17 side (for example, the left side in FIG. 1) located on one axial side. The inverter-side partition wall portion 3C closes an inverter 15 side (for example, the right side in FIG. 1) located on an opposite axial side. The armatures 4, the movable element 5, the support member 6, and the spring 7 are contained inside the casing 3.

The armatures 4 and the movable element 5 generate a magnetic attraction force and repulsion force therebetween in reaction to power supply to the armatures 4. Due to that, the movable element 5 in the form of a flat plate is driven so as to repeat a reciprocating motion between the pair of armatures 4 in the casing 3 in the length direction (=the axial direction of the cylinder 17). The spring 7 is made of, for example, a compression coil spring, and constantly biases the movable element 5 toward one side (the cylinder 17 side) of the casing 3 in the length direction. The spring 7 is elastically deflected and deformed so as to extend and compress when the movable element 5 reciprocates.

The casing 3 of the linear motor 2 contains a motor that includes the armatures 4, the movable element 5, and the like therein. Among them, the movable element 5 protrudes from the casing 3 toward inside the cylinder 17 of the compression portion 16. The movable element 5 includes an output shaft 8, which reciprocates by being driven by the linear motor 2. The piston 18 is provided on a protrusion end side of the output shaft 8. The output shaft 8 corresponds to a piston rod.

A piston support portion 10, which supports the piston 18, is formed on the piston 18 side of the output shaft 8. More specifically, the piston 18 side of the output shaft 8 is constituted by an axially extending rod portion 9 and the piston support portion 10 connected to this rod portion 9. The rod portion 9 of the output shaft 8 is supported by the cylinder-side partition wall portion 3B axially displaceably via a sliding bearing 11. The piston support portion 10 is attached at the distal end of the rod portion 9. In other words, the piston support portion 10 is provided on the distal end side (the piston 18 side) of the rod portion 9. In this case, the piston support portion 10 is formed into a disk-like shape smaller in outer diameter dimension than a lip ring 20, which forms the piston 18.

Figure 2:
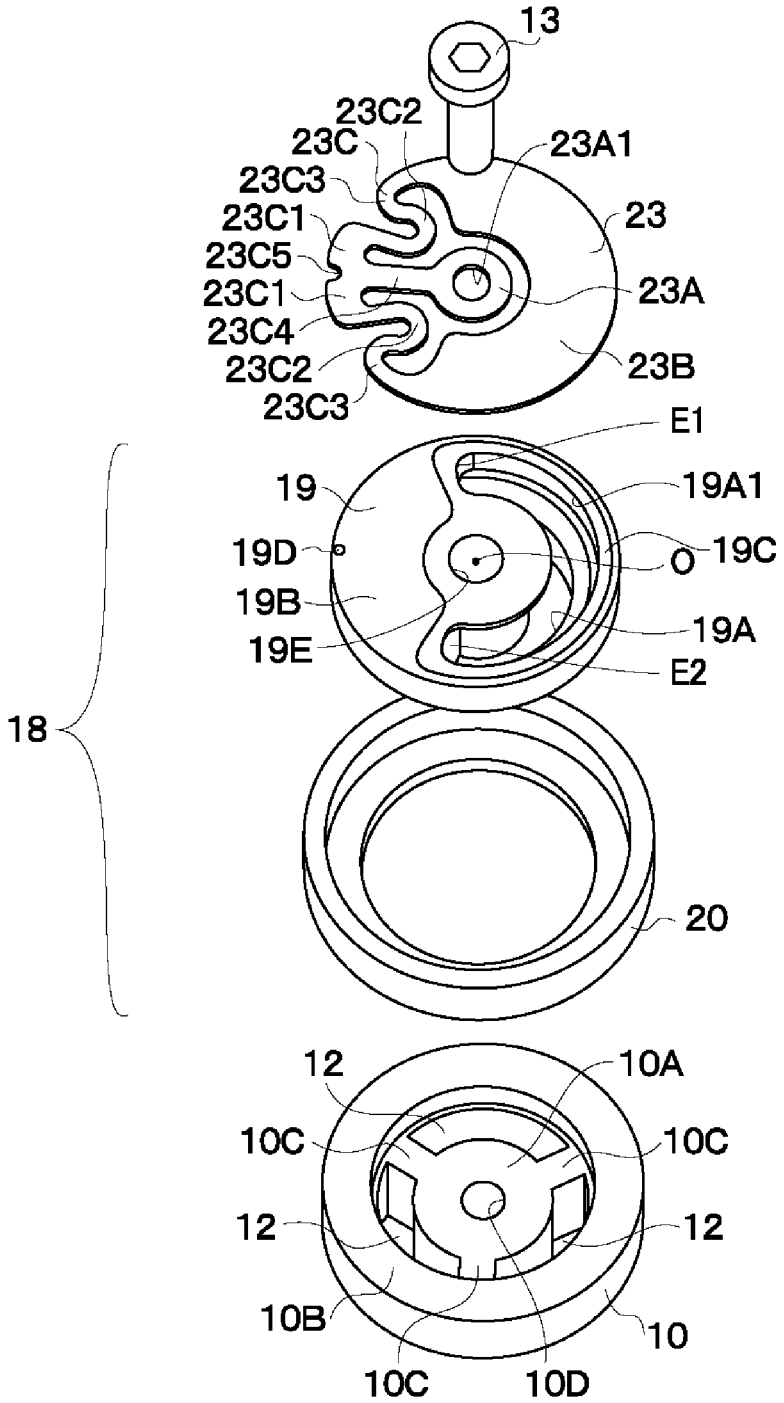

As illustrated in FIG. 2, the piston support portion 10 includes a columnar central portion 10A, a ring portion 10B, and a plurality of (for example, three) connection portions 10C. The ring portion 10B is located on the radially outer side with respect to the central portion 10A. The connection portions 10C are located between the central portion 10A and the ring portion 10B, and connect them. Airflow passages 12 are defined between the connection portions 10C circumferentially adjacent to each other. The airflow passages 12 are connected to a communication passage 19A of the piston 18. Accordingly, the piston support portion 10 includes the airflow passages 12 that establish communication between the communication passage 19A of the piston 18 and a suction chamber 22 of the compression portion 16. Further, an internal thread 10D is provided on the central portion 10A of the piston support portion 10. An attachment screw 13 is threadedly engaged with the internal thread 10D. The piston 18 (i.e., a piston main body 19 and the lip ring 20) and a suction valve 23 are attached to the piston support portion 10 using the attachment screw 13.

As illustrated in FIG. 1, a bottomed tubular inverter case 14 is provided on the other side of the casing 3 in the length direction, i.e., the opposite side from the compression portion 16. An inverter 15 is provided in the inverter case 14. The inverter 15 controls the driving of the linear motor 2. The inverter 15 includes, for example, a power transistor that generates a high voltage to be supplied to the armatures 4.

The compression portion 16 of the linear motor-type compressor 1 is, for example, provided in a state of being sandwiched between the linear motor 2 and an air dryer 28. The compression portion 16 includes the cylinder 17, the piston 18, the suction valve 23, a discharge valve 24, and a cylinder head 25. In the compression portion 16, the piston 18 axially reciprocates together with the movable element 5 of the linear motor 2, thereby compressing air (or already compressed air) in the cylinder 17 to generate compressed air (or further compressed air).

The cylinder 17 is formed into a bottomed cylindrical shape using a metal material such as aluminum. The cylinder 17 includes a cylindrical tubular portion 17A and a bottom portion 17B. The bottom portion 17B closes one end side (for example, the left side in FIG. 1) of the tubular portion 17A. A discharge hole 17C is provided on the bottom portion 17B. The discharge hole 17C extends through the bottom portion 17B. The cylinder 17 is attached to the cylinder-side partition wall portion 3B of the casing 3. More specifically, an attachment tubular portion 3D for fittedly attaching the tubular portion 17A of the cylinder 17 is provided on the cylinder-side partition wall portion 3B in a manner protruding toward the cylinder 17 side. The cylinder 17 is attached to the casing 3 by being sandwiched between the cylinder-side partition wall portion 3B and the cylinder head 25 in the state of being fittedly attached to the attachment tubular portion 3D of the cylinder-side partition wall portion 3B.

The piston 18 is reciprocatably (slidably) inserted inside the cylinder 17. The piston 18 is coupled with the movable element 5 of the linear motor 2. Due to that, the piston 18 is provided in the cylinder 17 slidably displaceably in the length direction of the linear motor 2 (the casing 3) (i.e., the axial direction of the cylinder 17 corresponding to the horizontal direction in FIG. 1). In other words, the piston 18 reciprocates in the cylinder 17 in conjunction with the reciprocating motion of the movable element 5. In this manner, the piston 18 is disposed on the same axis as the direction in which the movable element 5 of the linear motor 2 moves.

The piston 18 is reciprocatably and fittedly inserted in the cylinder 17. The piston 18 partitions the inside of the cylinder 17 into a compression chamber 21 and the suction chamber 22. The communication passage 19A and the suction valve 23 are provided on the piston 18. The communication passage 19A establishes communication between the suction chamber 22 and the compression chamber 21. The suction valve 23 covers the communication passage 19A openably and closably. In this case, the piston 18 includes the piston main body 19 and the lip ring 20. The communication passage 19A is provided in the piston main body 19. The lip ring 20 is provided on the outer peripheral side of the piston main body 19. A through-hole 19E is provided at the center of the piston main body 19. The attachment screw 13 is inserted through the through-hole 19E. The lip ring 20 seals between the piston 18 and the cylinder 17. The lip ring 20 is, for example, formed as a seal member made from a wear-resistant and self-lubricating resin material and having an L-shaped cross-section.

The compression chamber 21 is formed as a columnar space surrounded by the tubular portion 17A and the bottom portion 17B of the cylinder 17 and the piston 18. The suction chamber 22, which is also referred to as an intake chamber, is defined as a cylindrical space surrounded by the tubular portion 17A of the cylinder 17, the cylinder-side partition wall portion 3B of the casing 3, the piston 18, and the rod portion 9 of the output shaft 8. External air (or compressed air) flows into the suction chamber 22 via a suction port 3E provided on the cylinder-side partition wall portion 3B of the casing 3.

The suction valve 23, which is also referred to as an intake valve, is provided on the compression chamber 21 side of the piston 18. More specifically, the suction valve 23 is formed into a plate-like shape, and is attached to the piston 18. The suction valve 23 includes a fixation portion 23A, a closing portion 23B, and a spring portion 23C. The fixation portion 23A is fixed to the piston 18. The closing portion 23B covers an opening 19A1 of the communication passage 19A of the piston 18 openably and closably. The spring portion 23C causes the closing portion 23B to be tilted in a direction away from the opening 19A1 of the communication passage 19A by being elastically deformed.

During a suction stroke of the compression portion 16 (the piston 18), the suction valve 23 opens (unblocks) the communication passage 19A of the piston 18, thereby establishing the communication between the suction chamber 22 and the compression chamber 21 in the cylinder 17. During a compression stroke of the compression portion 16 (the piston 18), the suction valve 23 closes (blocks) the communication passage 19A of the piston 18, thereby disconnecting the compression chamber 21 and the suction chamber 22 in the cylinder 17 therebetween.

As illustrated in FIG. 1, the discharge valve 24 is provided between the bottom portion 17B of the cylinder 17 and the cylinder head 25. The discharge valve 24 covers one end of the cylinder 17 (more specifically, the discharge hole 17C of the bottom portion 17B of the cylinder 17) openably and closably. The discharge valve 24 includes a base portion 24A, an incomplete annular cutout 24B, and a closing portion 24C, for example. The base portion 24A is sandwiched between the bottom portion 17B of the cylinder 17 and the cylinder head 25. The closing portion 24C is located on the inner side with respect to the cutout 24B, and covers the discharge hole 17C openably and closably.

The discharge valve 24 (the closing portion 24C) closes the discharge hole 17C to block the communication between the compression chamber 21 in the cylinder 17 and a discharge chamber 26 in the cylinder head 25 during the suction stroke of the compression portion 16. The discharge valve 24 (the closing portion 24C) opens the discharge hole 17C to establish communication between the compression chamber 21 in the cylinder 17 and the discharge chamber 26 in the cylinder head 25 during the compression stroke of the compression portion 16.

The cylinder head 25 is attached to the one end side (for example, the left end side in FIG. 1) of the cylinder 17 so as to cover the bottom portion 17B of the cylinder 17. The cylindrical head 25 is formed into a bottomed tubular shape. The discharge chamber 26 is defined between the cylinder head 25 and the bottom portion 17B of the cylinder 17. The cylinder head 25 is provided on the air dryer 28 side as a discharge portion into which the compressed air is discharged. In this case, a plurality of fixation tools 27 is provided between the cylinder head 25 and the casing 3 (the cylinder-side partition wall portion 3B) of the linear motor 2. The fixation tools 27 couple the cylinder head 25 and the casing 3 to fix them.

The fixation tools 27 are arranged between the cylinder head 25 and the casing 3 (the cylinder-side partition wall portion 3B) of the linear motor 2 at circumferential intervals on the radially outer side with respect to the cylinder 17. The fixation tools 27 sandwich the cylinder 17 between the cylinder head 25 and the casing 3 (the cylinder-side partition wall portion 3B) of the linear motor 2. A discharge port 25A leading to the air dryer 28 is provided on the cylinder head 25. The discharge port 25A establishes communication between the discharge chamber 26 and the air dryer 28.

The air dryer 28 is attached to one end side of the cylinder head 25 (for example, the left end side in FIG. 1). In other words, the air dryer 28 is disposed opposite of the compression portion 16 from the linear motor 2. The air dryer 28 is filled with a drying agent therein. The air dryer 28 brings the drying agent into contact with the compressed air discharged from the compression portion 16, thereby absorbing moisture in this compressed air by the drying agent to dry it.

Now, securing an air volume and a pressure even when reducing the piston diameter (the cylinder diameter) of the compressor (the compression portion) raises the necessity of enlarging the opening (the port diameter) of the communication passage and increasing the lift amount of the plate-shaped valve (the suction valve or the intake valve). On the other hand, for example, the enlargement of the opening of the communication passage is accompanied by an increase in the area of the closing portion for closing the opening in the entire valve. This may make it difficult to secure a spring portion for increasing the lift amount, thereby making it difficult to secure the lift amount.

In other words, in the case where the suction valve (the intake valve) is provided to the piston in the compressor, a "portion for closing the opening (the closing portion)" and a "portion for defining the stroke (the spring portion)" are formed by the suction valve in the form of a single plate. In this case, simply reducing the piston diameter with the aim of reducing a load under a high pressure may make it difficult to achieve both the "securement of the area of the opening (the port diameter)" and the "securement of the spring portion for increasing the lift amount".

In light thereof, in the present embodiment, the central portion of the suction valve 23 is fixed to the piston 18 as the fixation portion 23A. Along therewith, the closing portion 23B for covering the opening 19A1 of the communication passage 19A openably and closably is provided on one radial side with respect to the central portion (the fixation portion 23A), and an area is secured for the opening 19A1 closed by this closing portion 23B. Further, the spring portion 23C is provided on an opposite radial side with respect to the central portion (the fixation portion 23A). Then, a relief step is provided on the seat surface of this spring portion 23C (a spring portion facing portion 19B of the piston 18).

Further, bent portions 23C1, 23C2, and 23C3 are provided on the spring portion 23C to reduce the spring constant. As a result, the present embodiment can enlarge the opening 19A1 of the communication passage 19A of the piston 18, and also increase the lift amount of the suction valve 23 (the distance by which the closing portion 23B is separated from the opening 19A1). The details thereof will be described now.

As illustrated in FIGS. 1 to 5, the compressor 1 according to the present embodiment includes the piston 18, the communication passage 19A, the opening 19A1, and the suction valve 23. The piston 18 partitions the inside of the cylinder 17 into the compression chamber 21, which corresponds to a first chamber, and the suction chamber 22, which corresponds to a second chamber. The piston 18 reciprocates in the cylinder 17. The communication passage 19A is formed in the piston 18. More specifically, the communication passage 19A is provided in the piston main body 19 forming the piston 18 as a through-hole axially extending through the piston main body 19. The communication passage 19A is in communication with the suction chamber 22 via the airflow passages 12 of the piston support portion 10. Due to that, the communication passage 19A establishes the communication between the compression chamber 21 and the suction chamber 22.

The opening 19A1 is provided on one end of the communication passage 19A and a one-side surface on the compression chamber 21 side of the piston 18 (for example, the left-side surface in FIG. 1 and the upper-side surface in FIG. 2). As illustrated in FIG. 2, the opening 19A1 is formed into a circular arc shape extending from a first end E1 to a second end E2 along the outer periphery (the outer peripheral edge) of the one-side surface of the piston 18. Then, the angle of the opening 19A1 defined by the first end E1, the second end E2, and a center O of the one-side surface exceeds 180 degrees. In other words, the opening 19A1 is located on the radially outer side of the circular piston 18 (the piston main body 19) and formed into a circular arc shape extending beyond 180 degrees circumferentially.

The suction valve 23 opens and closes the opening 19A1 of the communication passage 19A of the piston 18 (the piston main body 19). As illustrated in FIG. 2, the suction valve 23 has a plate-like shape. More specifically, the suction valve 23 has a generally disk-like shape. The suction valve 23 includes the fixation portion 23A, the closing portion 23B, and the spring portion 23C. The fixation portion 23A is fixed to the center of the one-side surface of the piston 18 (the surface on the compression chamber 21 side). For this reason, the fixation portion 23A is provided with an attachment hole 23A1, through which the attachment screw 13 is inserted.

Figure 3:
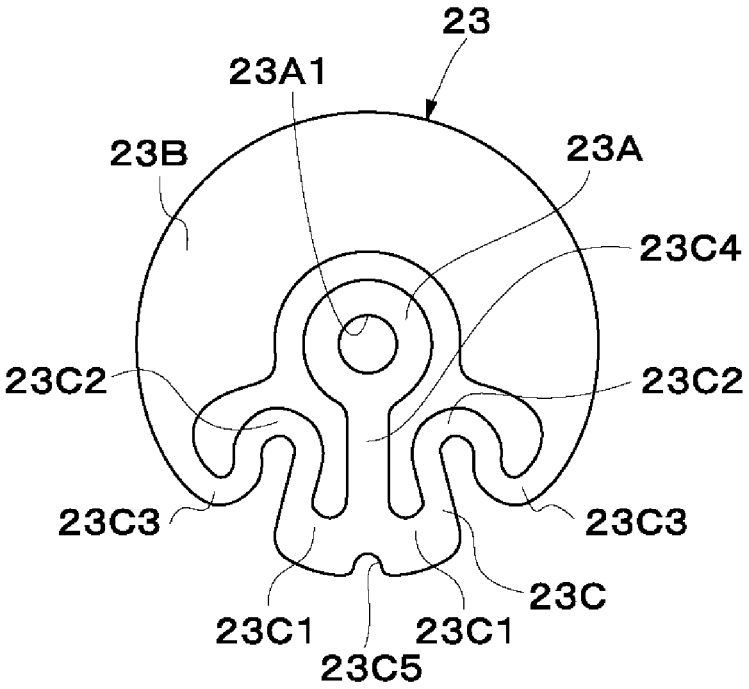
FIG. 3 is a plan view illustrating the suction valve.
Figure 4:
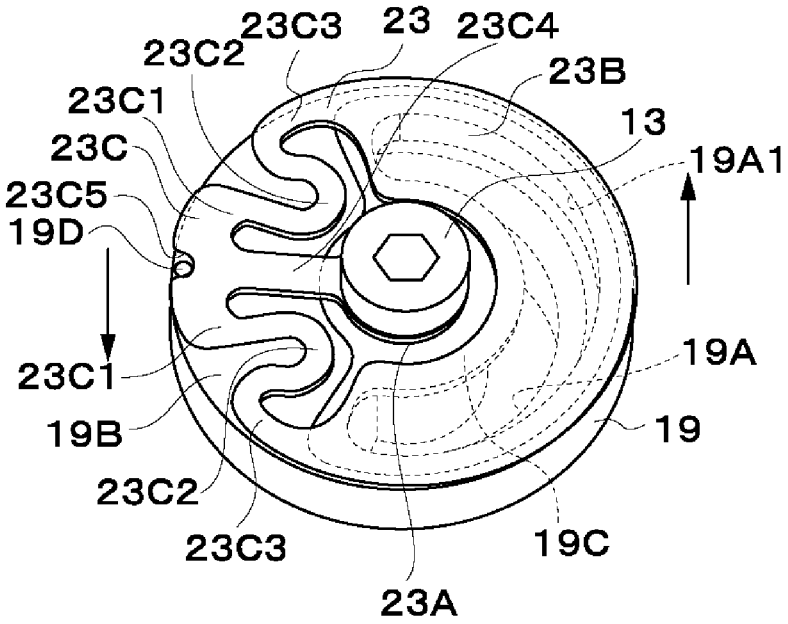
FIG. 4 is a perspective view illustrating the suction valve in a state of being attached to the piston.

The closing portion 23B is disposed on the one radial side with respect to the fixation portion 23A (for example, the right side in the horizontal direction in FIGS. 2 and 4, and the upper side in the vertical direction in FIG. 3). In this case, the closing portion 23B is disposed at a position corresponding to the opening 19A1 of the communication passage 19A of the piston 18 (the piston main body 19). The closing portion 23B is a portion that covers the opening 19A1 of the piston 18 openably and closably, and extends beyond 180 degrees circumferentially similarly to the opening 19A1 of the piston 18. The spring portion 23C is disposed on the opposite radial side with respect to the fixation portion 23A (for example, the left side in the horizontal direction in FIGS. 2 and 4, and the lower side in the vertical direction in FIG. 3). The spring portion 23C is provided radially opposite of the fixation portion 23A from the closing portion 23B. The spring portion 23C includes at least two bent portions, more specifically, the three bent portions 23C1, 23C2, and 23C3.

More specifically, the spring portion 23C includes a linear portion 23C4, first bent portions 23C1 and 23C1, second bent portions 23C2 and 23C2, and third bent portions 23C3 and 23C3. The linear portion 23C4 extends from the fixation portion 23A radially outward. The first bent portions 23C1 and 23C1 are folded back radially inward from one end side of the linear portion 23C4 (the radially outer side of the suction valve 23) by approximately 180 degrees in a U-shaped manner. The second bent portions 23C2 and 23C2 are folded back radially outward from opposite end sides of the first bent portions 23C1 and 23C1 (the radially inner side of the suction valve 23) by approximately 180 degrees in a U-shaped manner. The third bent portions 23C3 and 23C3 are curved circumferentially from one end sides of the second bent portions 23C2 and 23C2 (the radially outer side of the suction valve 23) by approximately 90 degrees, and are connected to the closing portion 23B.

Figure 5:
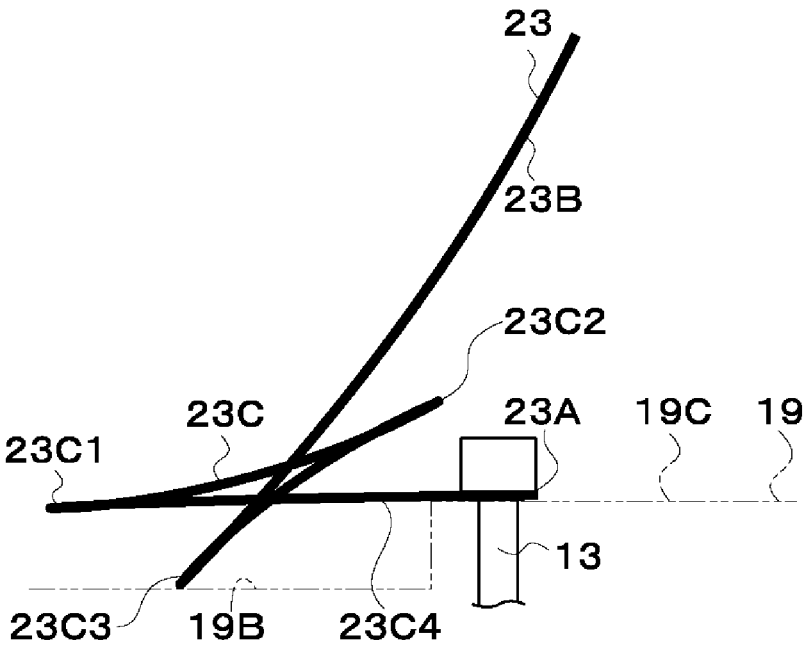
FIG. 5 exaggeratingly illustrates the suction valve with a spring portion thereof elastically deformed (with a closing portion separated from an opening of a communication passage of the piston).

The spring portion 23C configured in this manner causes the closing portion 23B to be tilted in the direction away from the opening 19A1 of the piston 18 by being elastically deformed as illustrated in FIG. 5. FIG. 5 exaggeratingly illustrates the spring portion 23C of the suction valve 23 in a state of being elastically deformed (i.e., in a state that the closing portion 23B is separated from the opening 19A1 of the piston 18 (the piston main body 19)).

Further, a positioning recessed portion 23C5 is provided at a position of the outer circumferential edge of the suction valve 23 that corresponds to the spring portion 23C (more specifically, a position corresponding to the one end side of the linear portion 23C4). The positioning recessed portion 23C5 is formed into a cutout shape recessed radially inward from the outer circumferential edge of the suction valve 23. The positioning recessed portion 23C5 is engaged with a rotation restriction portion 19D provided on the piston 18 (the piston main body 19).

On the other hand, the seat surface of the suction valve 23 is formed on the one-side surface of the piston 18 (the piston main body 19), i.e., the surface on the compression chamber 21 side (the surface on the suction valve 23 side). This seat surface includes the spring portion facing portion 19B, which faces the spring portion 23C of the suction valve 23, and a closing portion facing portion 19C, which faces the closing portion 23B of the suction valve 23. The communication passage 19A of the piston 18 (the piston main body 19) is opened to the closing portion facing portion 19C. Then, the spring portion facing portion 19B in the one-side surface of the piston 18 (the piston main body 19) is recessed more deeply than the closing portion facing portion 19C. In other words, the spring portion facing portion 19B serves as a stepped surface (a relief surface) recessed beyond the closing portion facing portion 19C. Therefore, as illustrated in FIG. 5, the suction valve 23 allows the closing portion 23B to be tilted in the direction largely away from the opening 19A1 of the piston 18 by entering the spring portion facing portion 19B side located at a lower position than the closing portion facing portion 19C when the spring portion 23C is elastically deformed.

Further, as illustrated in FIGS. 2 and 4, the rotation restriction portion 19D is formed on the spring portion facing portion 19B. The rotation restriction portion 19D restricts a rotation of the suction valve 23. The rotation restriction portion 19D is provided at a position on the radially outer side of the spring portion facing portion 19B that corresponds to the positioning recessed portion 23C5 of the suction valve 23. The rotation restriction portion 19D restricts a rotation of the suction valve 23 by being engaged with the positioning recessed portion 23C5 of the suction valve 23. In other words, the suction valve 23 can be positioned relative to the piston 18 (the piston main body 19) in the rotational direction with the aid of the engagement between the positioning recessed portion 23C5 of the suction valve 23 and the rotation restriction portion 19D of the piston 18 (the piston main body 19).

In this manner, according to the present embodiment, the piston 18 is provided in the cylinder 17. The piston 18 partitions the inside of the cylinder 17 into the compression chamber 21 corresponding to the first chamber and the suction chamber 22 corresponding to the second chamber, and reciprocates in the cylinder 17. The communication passage 19A is provided in the piston 18. The communication passage 19A establishes the communication between the compression chamber 21 and the suction chamber 22. Further, the suction valve 23 is fixed to the piston 18. The suction valve 23 opens and closes the communication passage 19A. As illustrated in FIG. 1, the discharge valve 24 is provided for the compression chamber 21, and the compression chamber 21 is in communication with the discharge port 25A via the discharge valve 24. The suction chamber 22 is in communication with the suction port 3E, which is also referred to as an intake port.

As illustrated in FIG. 2, the suction valve 23 is fixed to the one-side surface (the seat surface) of the piston 18 (the piston main body 19) at the fixation portion 23A, which is the central portion of the suction valve 23, using the attachment screw 13. The communication passage 19A is opened to the one radial side of the one-side surface of the piston 18 (the piston main body 19). The communication passage 19A leads to the suction chamber 22 below the piston 18. Further, the spring portion facing portion 19B is provided on the opposite radial side of the one-side surface of the piston 18 (the piston main body 19), i.e., the radially opposite side from the opening 19A1 of the communication passage 19A. The spring portion facing portion 19B serves as the relief step so as not to interfere with the motion (the elastic deformation) of the spring portion 23C when the suction valve 23 is opened.

The spring portion facing portion 19B is recessed more deeply than the closing portion facing portion 19C in the direction away from the suction valve 23. Further, the rotation restriction portion 19D is provided on the spring portion facing portion 19B in a manner protruding from the spring portion facing portion 19B. The rotation restriction portion 19D restricts a rotation of the suction valve 23. As illustrated in FIG. 3, the suction valve 23 includes the central fixation portion 23A, the closing portion 23B, and the spring portion 23C. The closing portion 23B is provided on the one radial side with respect to the fixation portion 23A, and closes the opening 19A1 of the communication passage 19A. The spring portion 23C is provided on the opposite radial side with respect to the fixation portion 23A, and connects the fixation portion 23A and the closing portion 23B. The bent portions 23C1, 23C2, and 23C3 are provided on the spring portion 23C.

The linear motor-type compressor 1 according to the present embodiment is configured in the above-described manner, and the operation thereof will be described next.

First, when a current is applied (power is supplied) to each of the coils (not illustrated) of the armatures 4 of the linear motor 2, the movable element 5 receives an axial thrust force. At this time, a magnetic attraction force and repulsive force are generated between the armatures 4 and the movable element 5 in reaction to the power supply to each of the coils (not illustrated) of the armatures 4, and this causes the movable element 5 in the form of a flat plate to repeat a reciprocating motion between the pair of armatures 4 in the length direction (the axial direction) in the casing 3.

The thrust force accompanying the reciprocating motion of the movable element 5 is transmitted to the piston 18 in the cylinder 17 forming the compression portion 16. The piston 18 repeats an axial reciprocating motion in the cylinder 17, and the compression operation is performed thereby. More specifically, during the suction stroke in which the piston 18 moves toward the suction chamber 22 side, the pressure in the compression chamber 21 reduces, and the suction valve 23 is opened. As a result, air (or compressed air) is sucked via the suction port 3E, and the air (or the compressed air) on the suction chamber 22 side flows into the compression chamber 21 side via the airflow passages 12 of the piston support portion 10 and the communication passage 19A of the piston 18.

Next, the suction valve 23 is closed during the compression stroke in which the piston 18 moves toward the compression chamber 21 side. Due to that, the pressure in the compression chamber 21 increases to open the discharge valve 24, and the compressed air is discharged to the discharge port 25A via the discharge chamber 26. The compressed air discharged from the discharge port 25A is, for example, supplied into an air chamber of an air suspension of the vehicle after being dried by the air dryer 28.

Then, when the suction valve 23 is opened, the bent portions 23C3 of the spring portion 23C are elastically deformed toward the seat surface side as illustrated in FIG. 5. The seat surface side of the piston 18 (the piston main body 19) is provided with the spring portion facing portion 19B, which serves as the relief step, recessed more deeply than the closing portion facing portion 19. This can prevent the interference with the motion (the elastic deformation) of the spring portion 23C, thereby contributing to increasing the lift amount of the suction valve 23.

Further, the bent portions 23C1, 23C2, and 23C3 are provided on the spring portion 23C, which can contribute to increasing the length of the spring portion 23C (i.e., the connection length from the fixation portion 23A to the closing portion 23B) even when the spring portion 23C is half or less as short as the seat surface, thereby reducing the spring constant. As a result, the passage area of the communication passage 19A can be secured and the suction resistance can be lowered.

In this manner, according to the present embodiment, the piston 18 includes the spring portion facing portion 19B, which faces the spring portion 23C of the suction valve 23 and the closing portion facing portion 19C, which faces the closing portion 23B of the suction valve 23. Along therewith, the spring portion facing portion 19B is recessed more deeply than the closing portion facing portion 19C. Therefore, when the spring portion 23C of the suction valve 23 is elastically deformed and the closing portion 23B is separated away from the opening 19A1 of the communication passage 19A, the spring portion 23C enters (is lowered into) the spring portion facing portion 19B recessed more deeply than the closing portion facing portion 19C. This makes it easy for the closing portion 23B to be tilted in the direction away from the opening 19A1.

Therefore, even when the opening 19A1 of the communication passage 19A of the piston 18 is enlarged, the closing portion 23B of the suction valve 23 can be separated from the opening 19A1 by a greater amount (lift amount). This can result in the achievement of both the "enlargement of the opening 19A1 of the communication passage 9A of the piston 18" and the "increase in the lift amount of the suction valve 23". Accordingly, even when the diameter of the piston 18 of the compressor 1 is reduced, the opening 19A1 of the communication passage 19A of the piston 18 can be enlarged and the lift amount of the suction valve 23 can also be increased, whereby a load under a high pressure can be reduced and the air volume and the pressure can be secured in addition thereto.

According to the present embodiment, the opening 19A1 of the communication passage 19A of the piston 18 extends beyond 180 degrees along the outer periphery (the outer peripheral edge) of the piston 18. Therefore, the opening 19A1 of the communication passage 19A can be enlarged and the efficiency of the compressor 1 can be improved.

According to the present embodiment, the spring portion 23C of the suction valve 23 includes at least two bent portions, more specifically, the three bent portions 23C1, 23C2, and 23C3. Therefore, the length of the spring portion 23C (the connection length from the fixation portion 23A to the closing portion 23B) can be secured, and the spring constant can be reduced. As a result, the lift amount can be increased and the discharged air amount can be secured.

According to the present embodiment, the rotation restriction portion 19D, which restricts a rotation of the suction valve 23, is formed on the spring portion facing portion 19B of the piston 18. Therefore, the suction valve 23 can be positioned with the aid of the rotation restriction portion 19D when the suction valve 23 is attached to the piston 18. This can contribute to facilitating the work of attaching the suction valve 23 to the piston 18.

The embodiment has been described assuming that the compressor 1 is configured to include the three bent portions 23C1, 23C2, and 23C3 as the spring portion 23C of the suction valve 23 by way of example. However, the spring portion is not limited thereto, and the bent portion of the spring portion may be provided at one portion or two portions or may be provided at four or more portions.

The embodiment has been described assuming that the opening 19A1 of the communication passage 19A is formed as an opening in a circular-arc shape extending beyond 180 degrees circumferentially by way of example. However, the opening of the communication passage is not limited thereto, and, for example, may be an opening in a circular-arc shape within 180 degrees. Further, the opening is not limited to the circular-arc shape, and, a shape different from the circular-arc shape, such as a fan-like shape, a polygonal shape, or a linear shape, may be employed. Further, the compressor 1 may be configured to include a plurality of communication passages or a plurality of openings.

The embodiment has been described assuming that the piston 18 of the compression portion 16 is configured as a swingable piston directly connected to the output shaft 8 (the rod portion 9) corresponding to the piston rod by way of example. However, the piston is not limited thereto, and may be a normal piston connected to the piston rod via a piston pin.

In the embodiment, the compression portion 16 has been described citing the linear motor-type compressor 1 driven by the linear motor 2 by way of example. However, the compressor is not limited thereto, and, for example, may be configured to drive (reciprocate) the compression portion (the piston) using a driving source different from the linear motor. In other words, the compressor may be any compressor in which a piston reciprocates. Further, the compressor may be used as a compressor that sucks atmospheric air and compresses it (a normal compressor) or may be used as a compressor that sucks compressed air (compression air) from a tank or the like and further compresses it (a booster compressor). Further, the compressor may compress gas different from air.

The embodiment has been described assuming that the compressor 1 is mounted on the vehicle by way of example. In this case, the compressor 1 may be applied to a closed-type air suspension system capable of storing compressed air in a tank. Alternatively, the compressor 1 may be applied to, for example, an open-type air suspension system not using a tank storing compressed air (i.e., a system that exhausts the compressed air to outside).

The embodiment has been described assuming that the compressor 1 is mounted on the vehicle by way of example. However, the compressor is not limited thereto, and can be mounted on various kinds of machines requiring a compressor. In other words, the compressor may be mounted on various kinds of machines different from a vehicle. Alternatively, the compressor may be used alone.

The embodiment has been described assuming that each of the linear motor 2, the compression portion 16, and the air dryer 28 are disposed in such a manner that the respective central axes match one another by way of example. However, the compressor is not limited to this example, and the description thereof shall not exclude, for example, a configuration in which the linear motor, the compression portion, and the air dryer are disposed at positions where the central axis of the compression portion and the central axis of the air dryer are offset from the central axis of the linear motor. Alternatively, the central axis of the linear motor and the central axis of the air dryer may be offset from the central axis of the compression portion, or the central axis of the linear motor and the central axis of the compression portion may be offset from the central axis of the air dryer.

According to the above-described embodiment, the piston includes the spring portion facing portion, which faces the spring portion of the suction valve, and the closing portion facing portion, which faces the closing portion of the suction valve. Along therewith, the spring portion facing portion is recessed more deeply than the closing portion facing portion. Therefore, when the spring portion of the suction valve is elastically deformed and the closing portion is separated away from the opening of the communication passage, the spring portion enters (is lowered into) the spring portion facing portion recessed more deeply than the closing portion facing portion, and this can make it easy for the closing portion to be tilted in the direction away from the opening. Due to that, even when the opening of the communication passage of the piston is enlarged, the closing portion of the suction valve can be separated from the opening by a greater amount (lift amount). This can result in the achievement of both the "enlargement of the opening of the communication passage of the piston" and the "increase in the lift amount of the suction valve". Accordingly, even when the piston diameter of the compressor is reduced, the opening of the communication passage of the piston can be enlarged and the lift amount of the suction valve can also be increased, whereby a load under a high pressure can be reduced and the air volume and the pressure can be secured in addition thereto.

According to the embodiment, the opening of the communication passage of the piston extends beyond 180 degrees along the outer periphery (the outer peripheral edge) of the piston. Therefore, the opening of the communication passage can be enlarged and the efficiency of the compressor can be improved.

According to the embodiment, the spring portion of the suction valve includes at least two bent portions. Therefore, the length of the spring portion can be secured and the spring constant can be reduced. As a result, the lift amount can be increased and the discharged air amount can be secured.

According to the embodiment, the rotation restriction portion, which restricts a rotation of the suction valve, is formed on the spring portion facing portion of the piston. Therefore, the suction valve can be positioned with the aid of the rotation restriction portion when the suction valve is attached to the piston. This can contribute to facilitating the work of attaching the suction valve to the piston.

REFERENCE SIGNS LIST

1 compressor
2 linear motor
17 cylinder
18 piston
19A communication passage
19B spring portion facing portion
19C closing portion facing portion
19D rotation restriction portion
19A1 opening
21 compression chamber (first chamber)
22 suction chamber (second chamber)
23 suction valve
23A fixation portion
23B closing portion
23C spring portion
23C1, 23C2, 23C3 bent portion
E1 first end
E2 second end
O center

The invention claimed is:

1. A compressor comprising:

a piston partitioning an inside of a cylinder into a first chamber and a second chamber, the piston being configured to reciprocate;

a communication passage formed in the piston and establishing communication between the first chamber and the second chamber;

an opening provided on one end of the communication passage and a one-side surface of the piston on the first chamber side; and a suction valve configured to open and close the opening, wherein the suction valve has a plate-like shape, the suction valve including a fixation portion fixed to a center of the one-side surface, a closing portion on one radial side with respect to the fixation portion, and a spring portion on an opposite radial side with respect to the fixation portion, wherein a spring portion facing portion on the one-side surface, which faces the spring portion, is recessed more deeply than a closing portion facing portion, which faces the closing portion, wherein the spring portion includes at least two bent portions for reducing a spring constant, wherein the opening is formed in a circular-arc shape extending from a first end to a second end along an outer periphery of the one-side surface, and wherein an angle defined by the first end, the second end, and the center of the one-side surface is larger than 180 degrees.

2. The compressor according to claim 1, wherein a rotation restriction portion is formed on the spring portion facing portion on the one-side surface, the rotation restriction portion being configured to restrict a rotation of the suction valve.

3. A compressor comprising:

a piston partitioning an inside of a cylinder into a first chamber and a second chamber, the piston being configured to reciprocate;

a communication passage formed in the piston and establishing communication between the first chamber and the second chamber;

an opening provided on one end of the communication passage and a one-side surface of the piston on the first chamber side; and a suction valve configured to open and close the opening, wherein the suction valve has a plate-like shape, the suction valve including a fixation portion fixed to a center of the one-side surface, a closing portion on one radial side with respect to the fixation portion, and a spring portion on an opposite radial side with respect to the fixation portion, wherein a spring portion facing portion on the one-side surface, which faces the spring portion, is recessed more deeply than a closing portion facing portion, which faces the closing portion, wherein the spring portion includes at least two bent portions for reducing a spring constant, wherein the spring portion includes a linear portion, first bent portions, second bent portions, and third bent portions, wherein the linear portion extends from the fixation portion radially outward, wherein the first bent portions are folded back radially inward from one end side of the linear portion in a U-shaped manner, wherein the second bent portions are folded back radially outward from opposite end sides of the first bent portions in a U-shaped manner, and wherein the third bent portions are curved circumferentially from one end sides of the second bent portions and are connected to the closing portion.

* * * * *